United States Patent [19]

O'Brien

[11] 4,356,660

[45] Nov. 2, 1982

[54] TWIRLING DISC

[76] Inventor: Kenneth J. O'Brien, 1657 Hawksway Ct., Westlake Village, Calif. 91361

[21] Appl. No.: 291,782

[22] Filed: Aug. 10, 1981

[51] Int. Cl.[3] ..... A63H 17/00

[52] U.S. Cl. ..... 46/60; 46/47

[58] Field of Search ..... 46/47, 74 D, 60, 1 R; 273/424, 403, 404; 84/411 P

[56] References Cited

U.S. PATENT DOCUMENTS

| | | | |
|---|---|---|---|
| 3,141,262 | 7/1964 | Burton | 46/47 |
| 3,453,924 | 7/1969 | Glick et al. | 84/411 P |
| 3,597,520 | 8/1971 | Andrews | 84/411 P |
| 4,204,357 | 5/1980 | Harrington | 273/424 X |

*Primary Examiner*—Mickey Yu

*Attorney, Agent, or Firm*—Fulwider, Patton, Rieber, Lee & Utecht

[57] ABSTRACT

A twirling disc adapted to be used by either a novice twirler or an expert twirler. The disc is provided with a pliable covering on one of its faces. The opposite face is provided with a hard covering. A novice twirler effects twirling of the disc by applying his twirling finger to the pliable covered face of the disc. An expert twirler engages his twirling finger with the face of the disc having a hard covering.

8 Claims, 7 Drawing Figures

TWIRLING DISC

BACKGROUND OF THE INVENTION

Many people find enjoyment from twirling a disc while such disc is balanced upon their index finger. Generally such discs are formed of a rigid material. Although an expert has comparatively little difficulty twirling a rigid disc, novice twirlers, and particularly children, find such twirling to be a difficult task.

SUMMARY OF THE INVENTION

It is an object of the present invention to provide a twirling disc which is adapted for use by either a novice twirler or an expert twirler.

A further object of the invention is to provide a twirling disc having one of its faces defined by a pliable material, and its other face defined by a hard material, with the pliable material being engaged by the finger of a novice twirler, and the hard material being engaged by the finger of an expert twirler.

Yet a further object of the present invention is to provide a twirling disc of the aforedescribed nature which is rugged of construction and yet may be manufactured at low cost.

These and other objects and advantages of the present invention will become apparent from the following detailed description of a preferred embodiment thereof.

DETAILED DESCRIPTION

Figure 1:
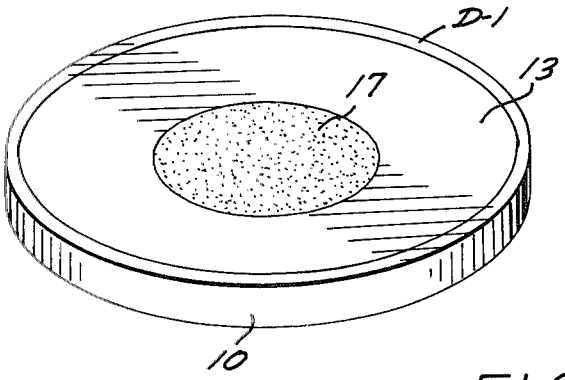
FIG. 1 is a perspective view showing a preferred form of twirling disc embodying the present invention, with the pliable material face of said disc facing upwardly.
Figure 2:
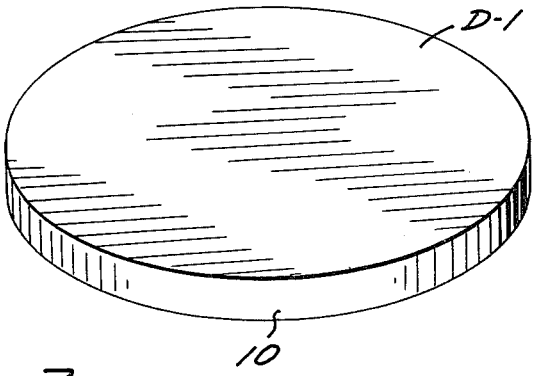
FIG. 2 is a perspective view similar to FIG. 1, but showing the hard material face of said disc facing upwardly.
Figure 7:
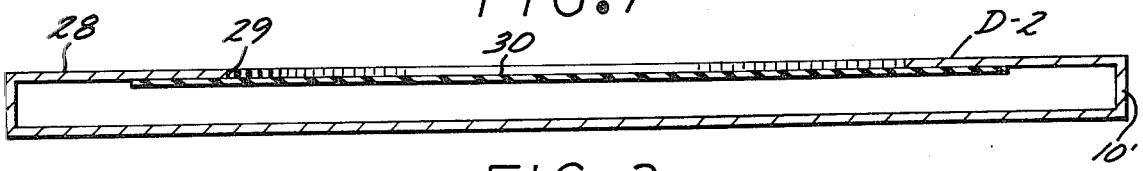
FIG. 7 is a vertical sectional view taken in enlarged scale along line 7—7 of FIG. 6.
Figure 3:
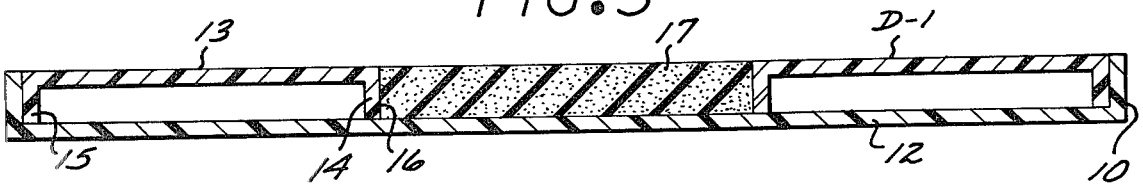
FIG. 3 is a central vertical sectional view of a first embodiment of said twirling disc.

Referring to the drawings, there is shown in FIGS. 1–5 a first embodiment of a twirling disc of the present invention. Such disc being designated D-1. Twirling disc D-1 includes an rigid annular rim 10 defining the periphery of such disc. Referring particularly to FIG. 3, the lower portion of rim 10 is bridged by a web 12 of hard material defining the lower face of the twirling disc. Preferably, rim 10 and web 12 will be integral. The material from which rim 10 and web 12 is formed may be of a comparatively hard material, such as synthetic plastic, paper or metal. The recess defined by rim 10 and web 12 receives an inverted ring, the upper surface of which coincides with the upper end of rim 10. Ring 13 includes depending inner and outer flange 14 and 15 that abut the upper surface of web 12. The annular hole 16 defined by inner flange 14 is shown filled with a pliable material 14 defining the upper face of the twirling disc. Such material is secured within annular hole 16 as by a suitable adhesive. The pliable material 17 may be of a spongy or foam texture, with such sponge or foam being formed of a conventional synthetic plastic.

Figure 4:
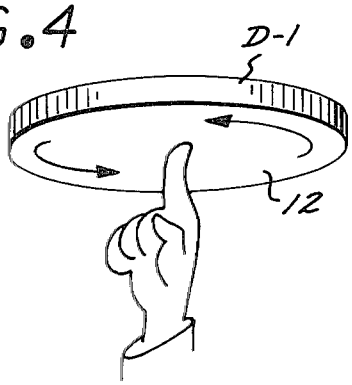
FIG. 4 is a perspective view showing how said twirling disc may be utilized by an expert twirler.
Figure 5:
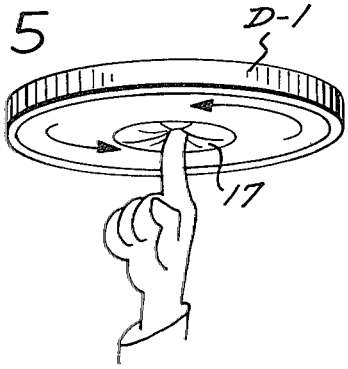
FIG. 5 is a view similar to FIG. 4, but showing how said twirling disc may be utilized by a novice twirler.

Referring now to FIG. 4, the twirling disc D-1 is shown being twirled while balanced upon the index finger of an expert or experienced twirler. It will be observed that his index finger is engaged with the hard material face of the twirling disc. In FIG. 5 the twirling disc is shown being twirled while balanced upon the index finger of a novice twirler. It will be observed that his index finger is engaged with the portion of the face of the twirling disc defined by pliable material 17. It should be understood that it is, of course, far easier for the twirling disc to be operated with the index finger of a twirler in engagement with the pliable material than with the hard material.

The aforedescribed twirling disc of the present invention permits a single disc to be employed by both novice and experienced twirlers. In practice, a novice twirler would begin his twirling activities using the pliable material face of twirling disc. Upon gaining confidence in his twirling abilities, the twirler would then reverse the faces of the twirling disc and balance such disc with his index finger in engagement with the hard material face of the twirling disc.

Figure 6:
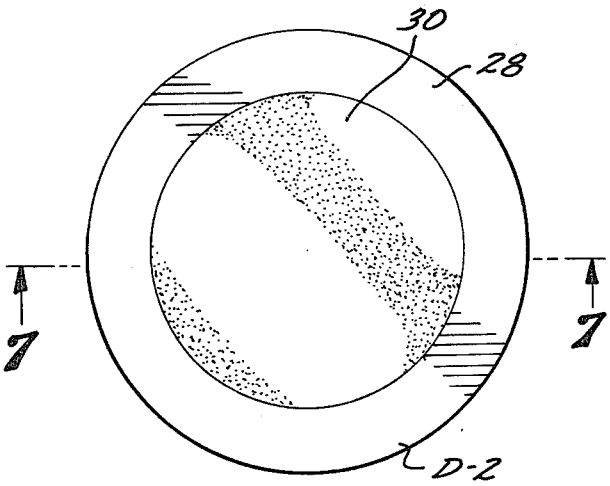
FIG. 6 is a top plan view of a second form of twirling disc embodying the present invention.

Referring now to FIG. 6, there is shown a second twirling disc D-2 embodying the present invention. This embodiment utilizes a rim 10' having its lower portion bridged by an integral material, preferably the same material as that utilized in forming the rim. An integral collar 28 extends radially inwardly from the upper edge of the rim to define a circular opening 29. In this embodiment of the invention, a round sheet of pliable material 30 is stretched across the opening 29. The radially outer surface of such material 30 is adhered to the underside of collar 28 by a suitable adhesive. Suitable materials from which to form sheet 30 are cloth, sponge, natural or synthetic rubber or a rubberized textile. This embodiment of twirling disc is utilized in the same manner described in connection with the twirling disc D-1.

Various modifications and changes may be made with respect to the foregoing detailed description without departing from the spirit of the present invention.

I claim:

1. A twirling disc toy adapted for use by either a novice twirler of an expert twirler, said twirling disc comprising:

a rim defining the periphery of said twirling disc;

a pliable material extending across said rim on one face thereof; and a hard material extending across said rim on the opposite face thereof, said pliable material for contacting the twirling finger of a novice twirler and said hard material of the disc for contacting the finger of an expert twirler.

2. A twirling disc as set forth in claim 1, wherein said rim and said hard material are integral.

3. A twirling disc as set forth in claim 1, wherein said pliable material is formed of sponge.

4. A twirling disc as set forth in claim 1, wherein said pliable material is a sheet stretched across said rim.

5. A spinning toy comprising a cylindrical disc formed with a circumferential rim and a first and second surface, said first and second surface being substantially parallel and each lying in a plane approximately perpendicular to the longitudinal axis of symmetry of said cylindrical disc, said first surface being characterized by a hard, smooth textured surface, and said second surface being characterized by a pliable region disposed about and generally centered about said longitudinal axis of said disc, said pliable region being surrounded by a nonpliable region extending to said rim, said pliable region of said second surface being characterized by a soft, deformable textured surface, adapted for contact with the twirling finger of a novice twirler whereby spinning of said toy is facilitated by contact between the twirling finger of a novice twirler and said pliable region, said finger of said novice twirler deforming said pliable region at the point of contact with said twirling finger, thereby increasing the degree of frictional engagement between said twirling toy and the twirling finger of a novice twirler, and whereby said first surface is adapted for contact with the twirling finger of an expert twirler so that frictional engagement between the twirling finger of said expert twirler and said first surface is minimized by said smooth, hard textured surface.

6. The spinning toy of claim 5 wherein said pliable region is disposed at least partially into said cylindrical disc and extends below said second surface, and is formed of a pliable material of sufficient deformability that the weight of said disc against the finger of said twirler in contact with said pliable region substantially deforms said pliable region to form an indentation therein in the proximity of said contact with said finger.

7. A method of learning to spin an object by practicing with a cylindrical disc having a first hard, smooth surface, and a second surface including a pliable region comprising the steps of:

spinning said cylindrical disc with a finger in contact with said pliable region wherein frictional contact between said finger and disc is enhanced by deformation of said pliable region by said finger;

repetitively continuing the spinning of said cylindrical disc with contact of said finger with said pliable region until a high degree of confidence and ability is obtained by a twirler to spin said cylindrical disc with said finger in contact with said pliable region by virtue of said repetition;

turning said disc to contact said disc with said finger on said first surface; and repetitively spinning said disc with said finger in contact with said hard, smooth first surface until a high degree of confidence and ability in spinning said disc with said finger in contact with said first surface is achieved, whereby the user acquires an ability to spin said object.

8. The method of claim 7 wherein said step of spinning said disc with said finger contacting said second surface having said pliable region includes substantially deforming said pliable region by contact of said finger therewith to form an indentation in said pliable region, thereby enhancing engagement and frictional contact between said finger and said spinning disc to aid ease of spinning until confidence and ability is obtained by said twirler.

* * * * *